United States Patent [19]

Howard

[11] Patent Number: 4,914,768

[45] Date of Patent: Apr. 10, 1990

[54] PORTABLE SHELTER

[76] Inventor: Jerald R. Howard, 5413 N. 46th Pl., Phoenix, Ariz. 85018

[21] Appl. No.: 280,977

[22] Filed: Dec. 7, 1988

[51] Int. Cl.[4] ..... A47C 29/00

[52] U.S. Cl. ..... 5/113; 5/414; 5/415

[58] Field of Search ..... 5/110, 114, 121, 414, 5/415; 441/130, 132; 297/184; 4/597; 135/88, 90, 102, 109; 224/153, 154, 156, 213

[56] References Cited

U.S. PATENT DOCUMENTS

| | | | |
|---|---|---|---|
| 3,546,461 | 12/1970 | Carlson | 135/90 |
| 3,601,825 | 8/1971 | Moorehead | 5/113 |
| 3,846,855 | 11/1974 | Peterson | 5/114 |
| 3,995,649 | 12/1976 | Robichaud | 135/102 |
| 4,093,305 | 6/1978 | Staroste et al. | 5/113 X |
| 4,193,413 | 3/1980 | Watts et al. | 135/109 X |
| 4,766,918 | 8/1988 | Odekirk | 135/90 X |

FOREIGN PATENT DOCUMENTS

| | | | |
|---|---|---|---|
| 840655 | 5/1970 | Canada | 5/113 |
| 2948713 | 6/1981 | Fed. Rep. of Germany | 224/153 |
| 2553981 | 5/1985 | France | 224/153 |
| 1536401 | 12/1978 | United Kingdom | 224/154 |

*Primary Examiner*—Michael F. Trettel
*Attorney, Agent, or Firm*—Gregory J. Nelson

[57] ABSTRACT

A portable shelter for use in connection with a foldable cot of the type having a tubular frame forming a center and end sections supportable on collapsible legs. Braces are pivotally attached to the frame and when upright, support an enclosure. The enclosure is a fabric material having pockets engageable about opposite ends of the frame. The entire unit can be folded with the frame sections in parallel relationship and the collapsed enclosure attached and carried as a backpack by a detachable harness. The shelter may be provided as a complete unit or the enclosure may be attached to an existing, conventional cot without the requirement of special drilling and fitting.

14 Claims, 3 Drawing Sheets

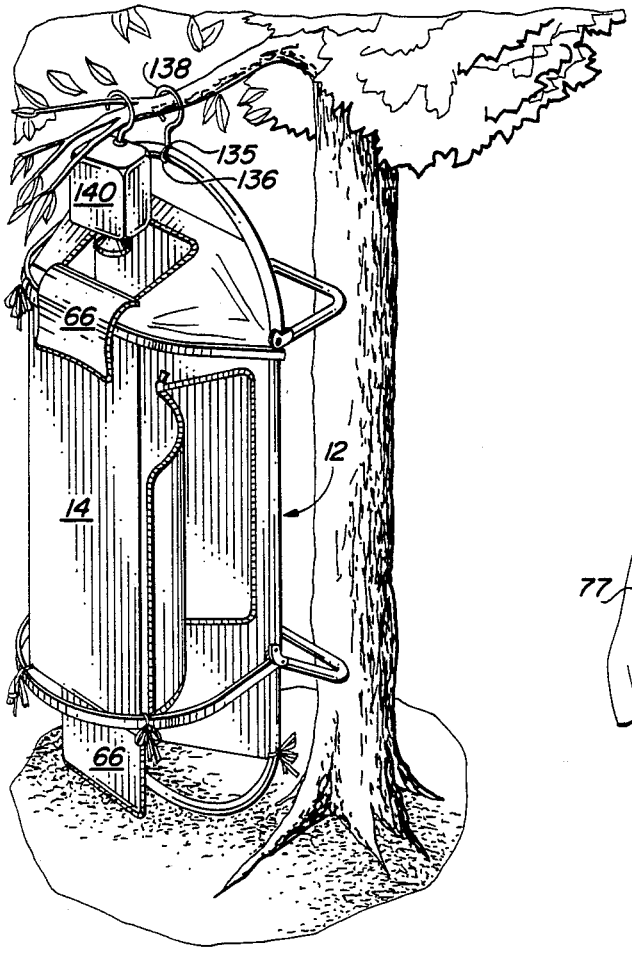
FIG. 9
FIG. 8
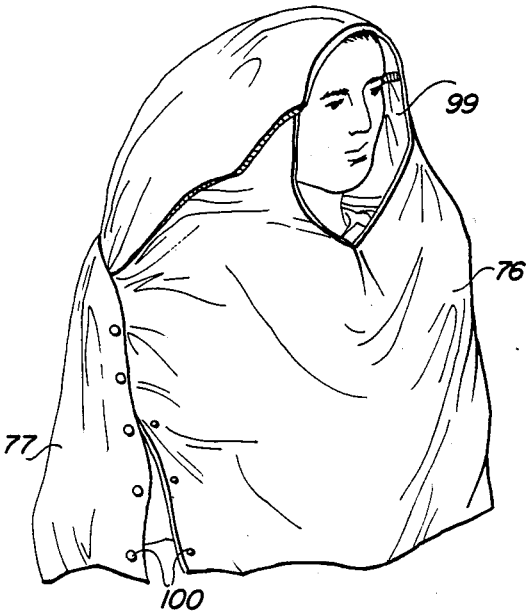
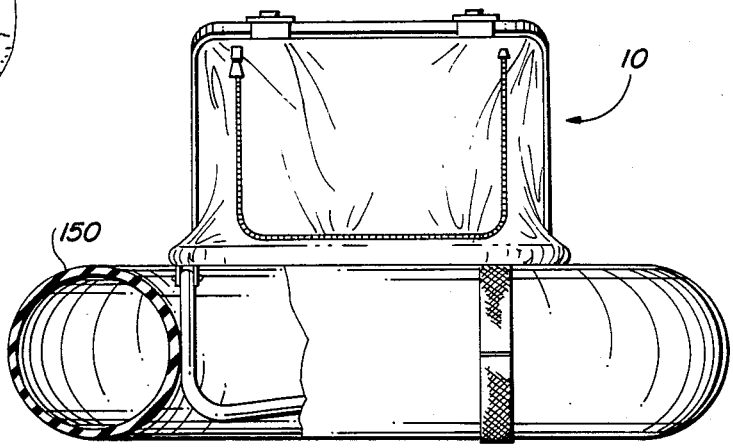
FIG. 10
FIG. 11
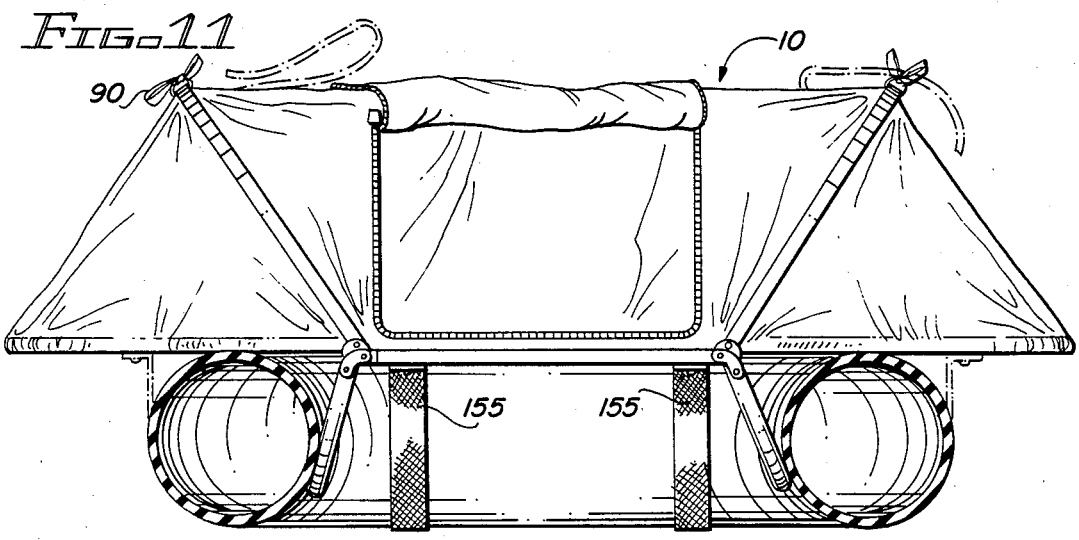

PORTABLE SHELTER

The present invention relates to an enclosed shelter. More particularly, the present invention relates to a shelter including a collapsible cot and enclosure which is collapsible into a compact unit for storage or for transportation on its frame as a backpack.

Folding light-weight beds or cots are used for various purposes. One primary use for such cots is for backpackers, hikers and campers. In general, these cots include a frame supported on legs which elevate the frame in a horizontal position above the ground. The cot frame has a covering of flexible material and the frame may be made of wood or metal and may be folded to a compact position, particularly suitable for storage and transportation.

Foldable beds or cots of this type are also used in other applications such as emergency situations where shelters are required for individuals as in the event of catastrophes or disasters. Cots of this type are provided by many governmental, relief and social service organizations for persons who are temporarily without a shelter. In these situations, it is desirable to have some type of cover or canopy in connection with a cot to protect the occupants from the environment and to provide the occupants some privacy.

Various types of folding beds or chairs in combination with covers and canopies can be found in the prior art. For example, U.S. Pat. No. 1,378,505 to J.L. White shows an early version of a combination chair and cot which has triangular end members supported at the head and foot of the cot. A ridge pole member extends between the end frames and a tent cloth forms the enclosure supported by the ridge pole.

Pat. No. 2,166,832 to H. Wenker discloses a sunshade attachment for deck chairs having a screen fabric attached at frames. The frames are attachable at the head and foot ends of a deck chair by means of metal supports screwed into the framework.

R. A. McDougall, U. S. Pat. No. 3,584,322 shows a tubular metal tent frame which may be attached and supported by the tubular metal frame of a conventional cot to support a tent or canopy over the cot to protect the occupants. The tent frame is formed of pivotally connected sections to enable it to be compactly folded for storage or transportation. The tent enclosure is formed of a flexible and waterproof material. The user enters and exists the enclosure by removing one of the braces.

Moorhead et al, U. S. Pat. No. 3,601,825, discloses a very similar device to that of McDougall in which two canopy brace structures, one at each end of the cot, are pivotally attached to hinge brackets on the side rails. The brackets slide along the rails to reduce spacing of the canopy brace structures to facilitate folding of the cot and to increase the canopy brace space to increase space within the cot.

Ipsen, Jr., U.S. Pat. No. 3,848,279 shows another type of folding bed in combination with a cover or canopy which serves to protect the occupants from the environment. The principal feature of the Ipsen, Jr. device is the provision of telescoping sides for each of the U-shaped frame members to reduce the size of the unit in the folded and retracted position.

While many of these devices provide substantial advantages, many of the prior art devices are deficient in that they do not quickly convert into canopy-folding and enclosed weatherproof, screened, out-of-doors recreational and emergency sleeping shelters.

Another common disadvantage of prior art devices is that they are either weighty or bulky and therefore are not conveniently portable and storable.

Accordingly, it is a primary object of the present invention to provide a light-weight and strong sleeping enclosure incorporating a cot of light-weight metal tubing which supports a flexible enclosure.

Another object of the invention is to provide a supporting frame and enclosure which enclosure may be easily attached to the cot by the user.

Another object of the invention is to provide an enclosure-supporting frame which is collapsible to a position so it may serve as a convenient means of carrying the cot and enclosure as a backpack.

Another object of the invention is to provide an enclosure which may be easily detached from the cot frame and folded and stored into a compact unit which may be attached or detached from the folded cot frame.

The apparatus of the present invention quickly converts a conventional foldable cot into a fully enclosed weatherproof, screened and ventilated sleeping shelter. For residential use, the invention provides an additional sleeping compartment which can be used on a patio or in a yard. For camping use, the cot and enclosure is compact and can be easily carried to the mountains, beach or other recreational location to provide fully sheltered sleeping accomodations. The present invention also has a substantial application as emergency relief shelters for the injured, destitute, or victims of a disaster. A particularly beneficial application of the invention is to provide sleeping facilities for those homeless persons temporarily without shelter. The shelter of the invention can be quickly and easily erected and collapsed without the need of any special tools so it can be easily stored and transported in comfortable fashion on the back of the user. The shelter may be provided as a complete unit or the flexible enclosure and support components may be provided the user and the shelter constructed by modification of a conventional folding cot of the type commercially available.

One significant advantage is that the shelter is easily fabricated from conventional components. Thus, the shelter may be fabricated by unskilled or semi-skilled workers without requiring extensive tools. Thus, particularly in the case of homeless, the individuals in need of the shelters may participate in the manufacturing of the shelters.

Briefly, the present invention provides a unitary covered shelter foldable to a compact condition suitable for transportation and storage. The shelter includes a for or bed having a foldable frame of lightweight material such as tubular aluminum having a central generally rectangular section. A pair of generally U-shaped legs are pivotally connected at opposite ends of the central rectangular frame member and when extended support the frame in a generally horizontal position above the ground. The generally U-shaped end members and U-shaped props or braces are pivotally connected at the opposite ends of the rectangular frame member. In the erected position, the U-shaped end members are extended in a generally horizontal position to form a horizontal sleeping surface with the central rectangular frame section. In the erected position, the braces extend generally perpendicular with respect to the horizontal frame member extending from opposite sides of the frame member to support the enclosure above the support surface to define a sleeping compartment. The ends of the enclosure are secured to the opposite U-shaped end members of the frame at sleeves or pockets defined by the enclosure. The enclosure may be provided with one or more ventilated or screened openings at opposite ends of the canopy. A suitable closable flap is provided in the canopy allowing the user access to the sleeping compartment.

In other embodiments of the present invention, the enclosure is collapsible and may be conveniently stored on e folded frame. When the frame is in the folded position, it may be supported and carried by the user by attachment of a shoulder harness in a manner similar to a conventional pack frame. The frame may be adjusted in size to better accomodate its use as a pack frame.

In still another embodiment of the present invention, an inflatable raft member may be secured to the underside of the frame to provide a small portable watercraft.

The above and other objects and advantages of the present invention will become more apparent from the derailed description of the invention as found in the following description and the accompanying drawings in which:

FIG. 8 is a front view similar to FIG. 5 showing the frame and enclosure carried in a manner similar to a backpack with a portion of the enclosure extended forming a full poncho to protect the wearer;

FIG. 9 is a perspective view illustrating the shelter of the present invention suspended in a vertical position to provide a stall or enclosure for privacy or as a shower;

FIG. 10 is an end view of an alternate embodiment of the invention in which the deflared watercraft is secured to the underside of the frame;

FIG. 11 is a side view of the embodiment of FIG. 7 with the watercraft shown in an inflated condition;

Figure 1:
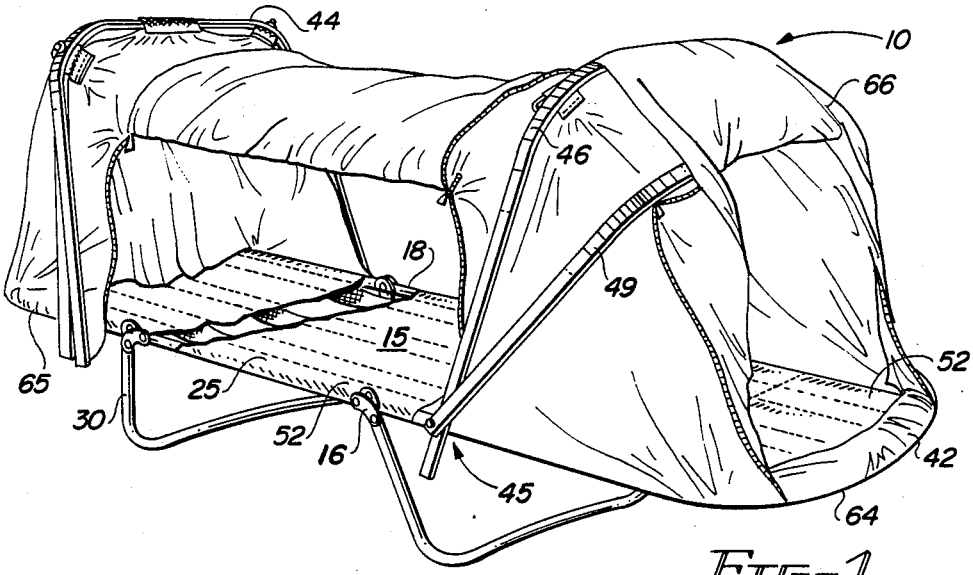
FIG. 1 is a perspective view of the shelter in a fully erected position.
Figure 2:
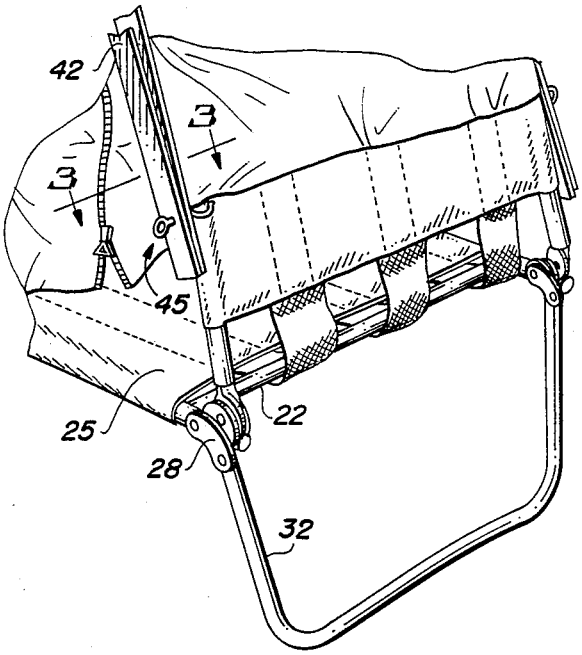
FIG. 2 is a detail perspective view of the pivotal connection of the legs, braces and members to the central frame section.
Figure 5:
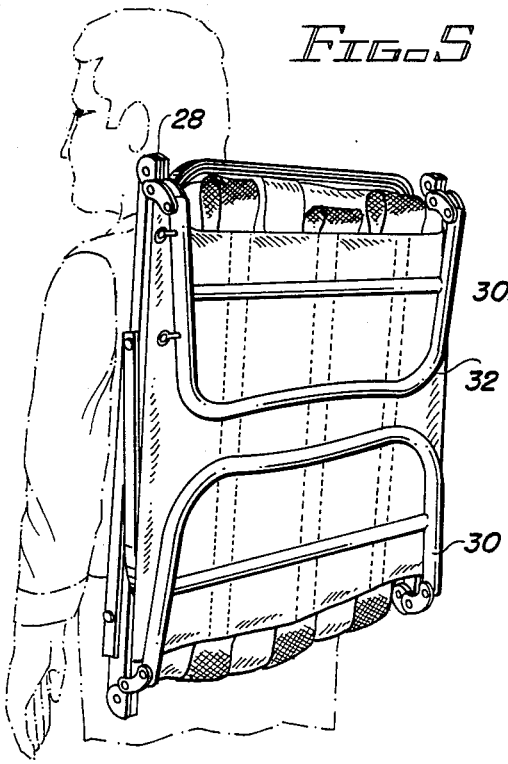
FIG. 5 is a rear view of the shelter in a collapsed condition transportable on the back of the user.
Figure 7A:
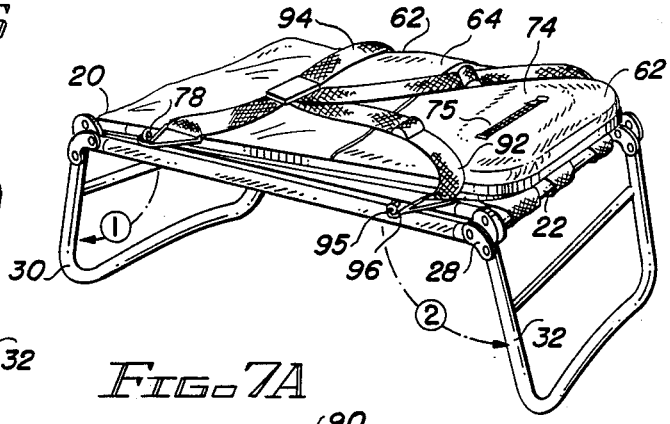
FIGS. 7A and 7B illustrate the erection of the enclosure with FIG. 7C illustrating the shelter in an erected position.
Figure 7B:
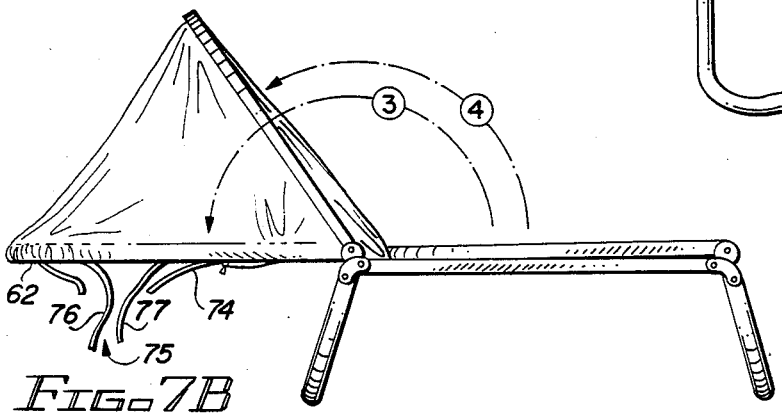
Figure 7C:
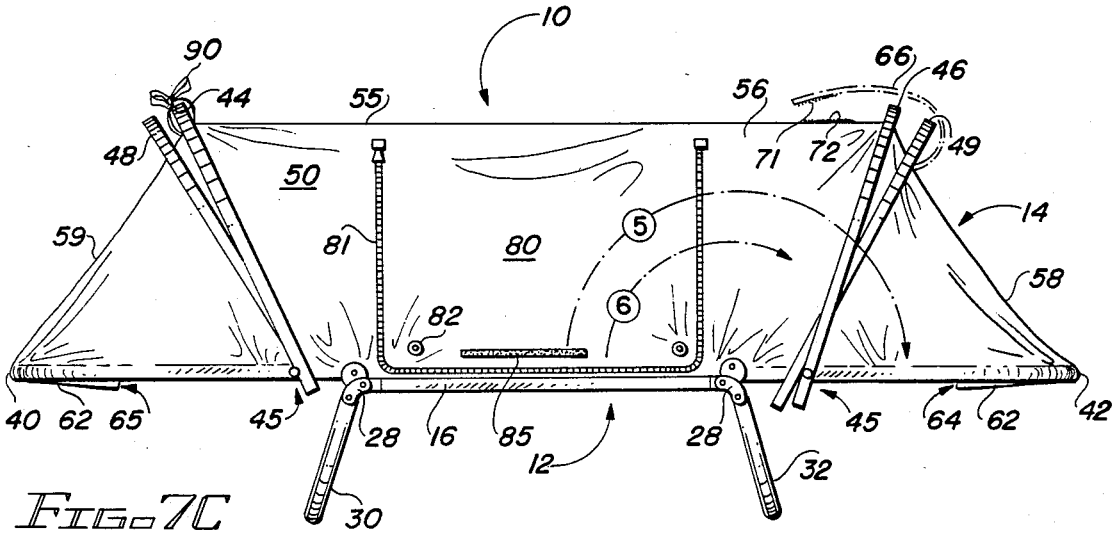

Turning now to the drawings, FIGS. 1 and 7C show the shelter assembly of the present invention in an erected position. The shelter is generally designated by the numeral 10 and includes a cot 12 and an enclosure 14. The cot 12 has a generally rectangular central section 15 consisting of spaced-apart, parallel side rails 16 and 18 having cross members 20 and 22 extending transversely at opposite ends of the side rails. For purposes of reference, the end defined by cross member 22 is designated the "top" end when the frame is folded as seen in FIG. 7A. Rectangular frame section 15 is preferably fabricated of lightweight material such as tubular aluminum and is provided with a covering 25 which may be canvas material extending between the side rails or may be transversely extending strips of vinyl or other material suitable for supporting the user. A hinge 28 is attached to the opposite ends of each of the side rails 16 and 18. Generally U-shaped legs 30 and 32 extend transversely of the frame each having a pair of vertically extending members which nave their distal end pivotally connected at hinges 28. In this way, legs 30 and 32 may be moved to a generally vertical supporting position as shown in FIG. 7C or may be folded to a position adjacent the underside of frame section 12 as seen in FIG. 5. A suitable detent or ratchet member may be associated with the hinge 28 to secure the legs in the selected position.

A pair of end frame members 40 and 42 are hingedly connected at opposite ends of the rectangular frame to the hinges 28. As shown, the hinges 28 provide a detent position so that the end members may be pivoted and secured in a generally horizontal position co-planar with the main frame section 15 as seen in FIG. 7C. The end members 40, 42 are generally U-shaped and may also be pivoted inwardly assuming a collapsed positron overlying the upper surface of the rectangular frame member 15, as seen in FIG. 7A. A suitable fabric, vinyl or similar covering extends across the end frame members 40, 42. The construction of the collapsible for as described above is more or less conventional and is set forth to facilitate an understanding of the invention which may be provided as a modification to conventional collapsible cots.

A pair of arched braces 44 and 46 extend transversely across the cot having their distal ends pivotally connected to the opposite sides of U-shaped end members 40 and 42 at hinges 45. Hinges 45 are provided with detents to secure the braces in an upright support position. The braces 44, 46 may also be inwardly pivoted to a stored position overlying and adjacent the central rectangular frame member, as best seen in FIG. 7A.

Figure 3:
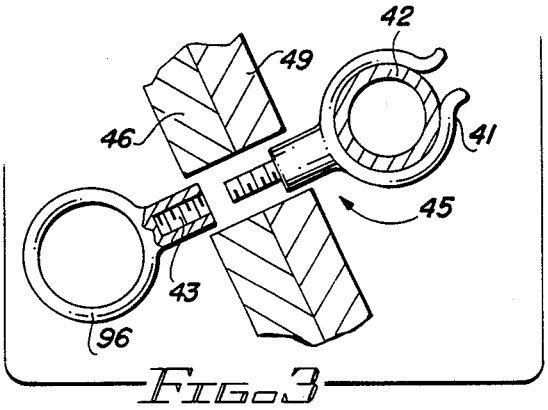
FIG. 3 is a sectional view taken along lines 3—3 of FIG. 2.

A second pair of arched braces 48, 49 also have their distal ends pivotally attached to pivot members 45 at the opposite frame end sections. Pivot members 45, are best seen in FIG. 3, each nave a spring clip 41 which engages the frame without the necessity of having to drill holes in the frame. Pin 43 projects from the clip and extends through bores in the ends of braces 44, 46, 48, 49 terminating at an enlarged ring or loop 96. Braces 48, 49 closely conform in size and shape to braces 44 and 46. When the brace pairs 44, 48 and 46, 49 are erected, they may be positioned adjacent one another or may be angularly separated as shown in FIG. 7C to support the enclosure and to provide an adjustable canopy support member as will be explained.

The enclosure 14 portion of the shelter is fabricated from a suitable waterproof material such as canvas, ripstop nylon or the like. As best seen in FIGS. 1 and C, enclosure 14 has an elongate body 50 with a floor 52 which generally conforms in size and shape to the horizontal surface defined by frame members 16, 18, 40 and 42. Body 50 is attached along its lower marginal edge of the floor 52 by a stitching or by a zipper or hook and loop-type fasteners sold under the trademark Velcro. Body 50 has a top 55 and opposite sides 56 and 57 and is essentially co-extensive with the frame. End panels 58 and 59 are provided at opposite ends of the body and in the erected position are taut and extend generally from the U-shaped braces 44 and 46 to the end of the opposite U-shaped frame members 40 and 42.

Panels 62 are provided at the opposite ends of the enclosure on the underside of the floor 52 to define sleeves 64 and 65, FIGS. 7B and 7C. The sleeves are generally semi-circular and adapted to receive a portion of the U-shaped end frame members 40 and 42. The outer surface of sleeve 64 is provided with a pocket 74 having an opening 75 fitted with a zipper or other suitable closure. In the folded position, pocket 74 is ar the top of the frame and is accessible as seen in FIG. 7A. Pocket 74 contains panels 76 and 77 which may be extended from the pocket and draped over the user and backpack for protection when necessary in the backpack mode, as seen in FIG. 8. The panels are provided with marginal fasteners 100 so the edges of the panels may be secured together. An opening 99 is provided in panel 76 so the panel may be placed over the head of the wearer without obstructing vision. When not in use, the protective poncho-type panels are folded and conveniently stored in the pocket 74.

Figure 4:
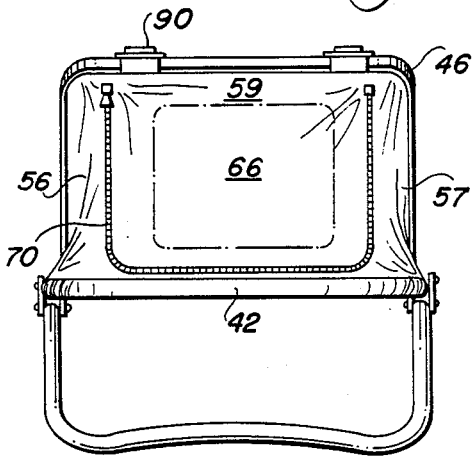
FIG. 4 is an end view of the for and enclosure.

As seen in FIG. 4, a ventilation opening is shown at opposite ends of the enclosure formed by flaps 66 each of which has a peripherally extending zipper 70. The zipper may be engaged to close the vent openings when desired. The zippers 70 are double-faced to allow the user to open the vent flaps from either the interior or the exterior. In the open position the lower end of the flaps 66 may be secured to the top 55 of the enclosure by mating loop and hook fastener strips 71, 72. Braces 48, 49 may be pivoted taking up the slack in the panel to fully expose the opening and to provide a canopy-like member at the upper side of the opening.

Access panels 80 are provided in rne side walls 56, 57 of the enclosure body preferably in the area between the braces 44 and 46 when the enclosure is erected. These panels may be provided with a suitable peripheral closure such as a zipper 81 or other fastener component such as the type sold under the trademark Velcro. The panels 80 may be extended in a generally horizontal position and may be supported in this position to provide a shade by appropriate ground stakes, not shown, which cooperate operate with grommets 82 to support the cover in the open horizontal position. When desired, the enclosure can be closed and secured by the fasteners 81 as shown in FIG. 7C. Panels 80 may also be folded over the top of rne body as seen in FIG. 1 and secured in this position by interconnecting the mating loop and nook fasteners associated with the lower edge of the panels. Suitable ties 90 are secured to the top outer surface of the enclosure and may be fastened to the braces 44 and 46 at suitable locations.

As best seen in FIG. 7A, the flexible enclosure can normally be stored on the frame when the frame is collapsed. In this position, the cot frame and enclosure may be conveniently transported by the user. In the collapsed position, braces 44, 48 and 46, 49 are folded inwardly assuming a position overlying the central rectangular frame portion of the cot. THe U-shaped end members 40 and 42 are similarly folded inwardly assuming a position adjacent the inwardly folded brace. Legs 30 and 32 may remain in their extended position to provide a support surface for a pack 85, as seen in FIG. 7A or may be inwardly folded on the underside of the frame, as shown in FIG. 5.

To facilitate transportation, a harness assembly, as best seen in FIG. 7A, includes shoulder straps 91, 92 and belt 94 which are secured to the cot frame for transportation in a manner similar to a backpack. Belt 94 extends transversely over the folded end sections being detachably secured at rings 78. Shoulder straps 91 and 92 extend angularly from the midpoint of belt 94 to the corners of the folded frame being detachably secured to the frame by rings 96 at snaps 95.

When the frame and pack are carried as a backpack using the harness, the folded frame is conveniently transportable with pocket 74 immediately behind the head of the wearer at the top of the frame. As shown in FIG. 8, the panels 76, 77 may be extended from their pocket 74 and used as a poncho to fully protect the body of the person carrying the pack as illustrated in FIG. 5. An opening 99 may be advantageously positioned in the panel 76 so the user's vision is not impaired. Thus, the upper body of the user's head is protected from the environment, weather, sun and insects. Netting may be provided across opening 99 for additional protection. Panels 77 and 76 may be joined together at cooperable fasteners 100 along the sides of the panels.

When it is desired to utilize the shelter, the frame is erected as shown in FIGS. 7A to 7C with the legs 30, 32 depending from the frame to support the frame above the ground in a generally horizontal positron. End members 40 and 42 are unfolded and locked in a generally horizontal position providing a support surface for the individual. The braces 44, 48 and 46, 49 are pivoted and raised to an upright position.

The fabric enclosure is positioned on the horizontal portion of the cot with opposite sleeves 64, 65, respectively engaging end member 42 and opposite end member 40. The enclosure is erected by securing ties 90 to braces 44 and 46 at suitable locations. Access panels 80 may be opened and end flaps 66 may be secured to the top 55 of the enclosure at mating fasteners 71, 72 and adjusted as a canopy by pivoting the respective brace 48 or 49 to the desired position. To collapse the shelter, the procedure is reversed and the shelter assumes the compact position of FIG. 5. The collapsed shelter in the position shown in FIG. 5 serves as a pack frame.

Figure 6:
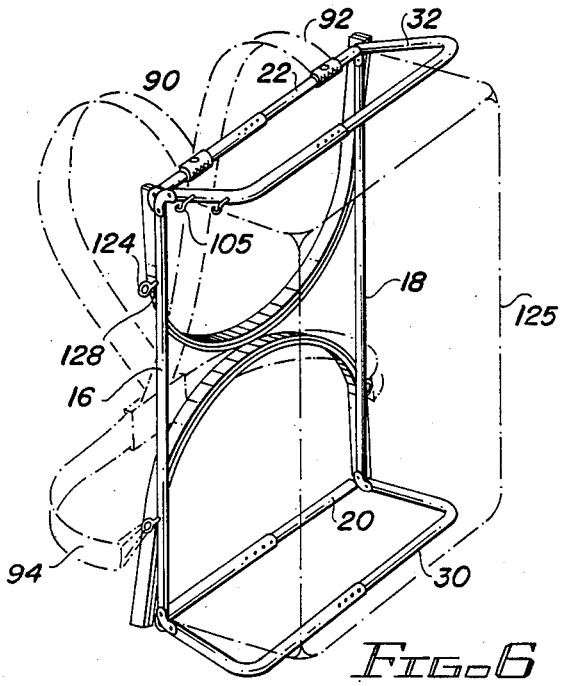
FIG. 6 shows a modification of the shelter in a folded position serving as a back frame for a pack.

The frame may be used to transport other camping materials and accordingly, as seen in FIG. 6, a cooperative pack 125 may be provided and partially supported on legs 30 and 32. Pack 125 is rectilinear generally conforming in size to the frame. Tabs 128 are provided at opposite sides of pack 125 having fastener members 124 which cooperate with selected of fastener members 105 on the frame Fasteners 105 are for attachment of camping gear items to the frame.

Figure 12:
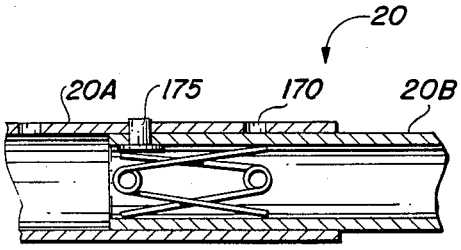
FIG. 12 is an enlarged view of a portion of the frame as indicated in FIG. 6 illustrating the telescoping transverse frame members.

In some instances the width of the frame may be too great for comfortable use as a backpack. Accordingly, to adjust the width to the physical requirements of the wearer, the transverse members 20, 22, 30 and 32 may be adjustable as seen in FIG. 12 which shows member 20 but is typical. Member 20 has a larger tubular section 20A which slidably receives section 20B. Outer tubular member 20A is provided with an aligned series of holes which can be selectively registered with spring biased detent member 175 to adjust the overall width of the frame for storage and transportation.

In addition to serving as a pack frame and enclosure, the device of the present invention may serve as a privacy stall. Referring to FIG. 9, the shelter is erected as shown in FIG. 1 and is shown suspended in a vertical position by the strap harness 94 or a hanger member 135. Hanger member 135 has a lower hook portion 136 which is attachable to one of the end frames 40 and 42 to suspend the enclosure in the vertical position. The opposite nook portion 138 may be secured about any suitable member such as a tree branch as shown. In this position, the panels 66 at opposite ends are opened and the user may stand within the area defined by the vertically suspended enclosure providing privacy for a shower or the like. In the event the device is to be used as a portable shower stall, a solar heated not water source 140 may be suspended in position over the upper opening If the enclosure is made of a material such as ripstop nylon, it will tend to dry quickly after use.

As seen i FIGS. 10 and 11, the device of the present invention may also be used in conjunction with an inflatable raft member. As seen in these figures, an inflatable tube 150 is secured to the frame and is generally configured to be received on the underside of the frame and may be attached to the frame by a plurality of straps 155 which extend about the tube and selected frame members. When the tube 150 is inflated, it assumes a position beneath the horizontal platform and tightly engaging the extended leg members. In this position, the raft member will provide buoyancy and support the frame member. The frame may be used with or without the enclosure. In the case of inclement weather, the enclosure may first be attached to the frame and erected as described above. In this manner, the frame and enclosure may be used as a small one-man boar for hunting, fishing or other recreational activities.

When it is desired to store the raft, the tube member 150 is deflated and fastener members 155 removed from the frame. The tube 150 can then be folded and can be attached to the frame for transportation when the frame is carried as a backpack.

Thus, it will be seen the foregoing provides a unique and highly versatile shelter which may be used for various purposes. The device can be used as a temporary shelter for homeless, as a camping shelter which serves as a backpack and even as a small portable watercraft. The device may be provided as a complete unit or may be provided as a kit for attachment to an existing cot frame.

It will be obvious to those skilled in the art to make various changes, alterations and modifications to the portable shelter described herein. To the extent such changes, alterations and modifications do not depart from the spirit and scope of the appended claims, they are intended to be encompassed herein.

I claim:

1. A portable shelter for use with a foldable cot of the type having a frame with a center section and opposite end sections piviotally secured to said center section to enable the sections to be compactly folded from an open extended position to a closed position and with the section generally overlapping, said cot having spaced-apart support legs pivotally attached to said frame, said shelter comprising:

(a) an integral flexible enclosure having a top, floor, opposite sides and opposite ends, said floor being substantially continually secured to said ends and sides, said floor having panels attached to its underside at, said opposite ends, said panels and floor defining pockets at opposite ends of the enclosure adapted to receive and engage at least a portion of said frame end sections;

(b) a first brace member extending transverse of said cot frame having opposite legs and a bight portion, said legs being pivotally connected to said frame at pivot means;

(c) a second brace member extending transverse of said cot frame having opposite legs and a bight portion, said legs being pivotally connected to said frame at pivot means at a location spaced from said first brace member;

(d) means for detachably securing said enclosure to said first and second brace members whereby movement of said braces to an upright position with respect to said frame will move said enclosure to an erected taut position and whereby said braces may be folded to a compact position with said enclosure retained in a collapsed condition on said frame.

2. The shelter of claim 1 wherein said enclosure is provided with access panels in opposite sides having fasteners associated therewith which are securable at the top of the enclosure to maintain the panels in an open position.

3. The shelter of claim 1 wherein said frame member includes attachment means thereon and further including harness means detachably securable to said attachment means whereby the cot and enclosure may be transported by the individual as a backpack.

4. The shelter of claim 3 further including a pack that is detachably securable to said frame, said pack acting as a storage compartment.

5. The shelter of claim 4 wherein said enclosure includes a pocket receiving at least one foldable cover panel therein which may be extended over the individual for protection when transported as a backpack.

6. The shelter of claim 5 including a second foldable cover panel extendable from said pocket, said first and second cover panels being joinable at fasteners associated therewith.

7. The shelter of claim 1 wherein said enclosure is provided with openings having flaps at opposite ends thereof.

8. The shelter of claim 7 further including a third brace member commonly pivotal with said second brace member and a fourth brace member commonly pivotal with said second brace member, said third and fourth brace members engageable with said end flaps to form a canopy.

9. The shelter of claim 1 wherein said means for detachably securing said enclosure to said first and second brace members comprises ties associated with said enclosure engageable about said brace members.

10. The shelter of claim 1 wherein said first and second brace members are pivotally connected to said frame at detachable pivot means.

11. The shelter of claim 10 wherein said detachable pivot means include a clip attachable about said frame with a pivot shaft extending therefrom.

12. The shelter of claim 1 further including inflatable means for supporting the shelter in water detachably securable to said frame.

13. The shelter of claim 1 further including suspension means to support said shelter in a generally vertical position.

14. The shelter of claim 1 wherein said frame is telescopically adjustable in width.

* * * * *